US005223895A

United States Patent [19]

Saitoh

[11] Patent Number: 5,223,895

[45] Date of Patent: Jun. 29, 1993

[54] IMAGE FORMING APPARATUS HAVING MESSAGE OUTPUT FUNCTION

[75] Inventor: Takashi Saitoh, Tokyo, Japan

[73] Assignee: Kabushiki Kaisha Toshiba, Kawasaki, Japan

[21] Appl. No.: 617,874

[22] Filed: Nov. 26, 1990

[30] Foreign Application Priority Data

Nov. 29, 1989 [JP] Japan ..... 1-309978

[51] Int. Cl.[5] ..... G03G 21/00

[52] U.S. Cl. ..... 355/206; 355/209

[58] Field of Search ..... 355/200, 202, 204, 206, 355/208, 209, 210, 211, 308, 309; 346/138, 153.1; 358/300

[56] References Cited

U.S. PATENT DOCUMENTS 4,922,294 5/1990 Nakagami et al. ..... 355/209

4,977,429 12/1990 Tani et al. ..... 355/206 X

*Primary Examiner*—Leo P. Picard

*Assistant Examiner*—Christopher Horgan

*Attorney, Agent, or Firm*—Foley & Lardner

[57] ABSTRACT

Various maintenance manuals for an image forming apparatus are stored in a message memory. When a total image forming numbers formed in the apparatus reaches a predetermined count, and after the formation of the all image data which has been supplied from a host unit is completed, a selected manual for the maintenance operation is printed out on a paper, so that an operator can perform the predetermined maintenance operation using the printed manual.

10 Claims, 11 Drawing Sheets

<CHARGER WIRE CLEANING>

(1) REMOVE FRONT AND REAR COVERS, AND REMOVE SPRINGS (FRONT) AND TERMINAL (REAR) THEREFROM, RESPECTIVELY.

(NOTE) 1. WIRES SHOULD BE INSERTED INTO V-GROOVES CORRECTLY AT BOTH FRONT AND REAR SIDES.

2. DON'T WIPE CHARGER WIRES BY FINGERS (CURRENT FLOWING INTO DRUM WILL BE CHANGED.)

<CHARGER WIRE CLEANING>

(1) REMOVE FRONT AND REAR COVERS, AND REMOVE SPRINGS (FRONT) AND TERMINAL (REAR) THEREFROM, RESPECTIVELY.

(NOTE) 1. WIRES SHOULD BE INSERTED INTO V-GROOVES CORRECTLY AT BOTH FRONT AND REAR SIDES.
2. DON'T WIPE CHARGER WIRES BY FINGERS (CURRENT FLOWING INTO DRUM WILL BE CHANGED.)

IMAGE FORMING APPARATUS HAVING MESSAGE OUTPUT FUNCTION

BACKGROUND OF THE INVENTION

1. Field of the Invention

The present invention relates to an image forming apparatus such as a laser printer and, more particularly, to an image forming apparatus for outputting a message such as a maintenance operation manual.

2. Description of the Related Art

Image formation in a conventional image forming apparatus such as a laser printer is performed by processes such as charging, exposure, development, transfer, separation, cleaning, and fixing. In such an image forming apparatus, a charging unit, an exposure unit, a developing unit, a transfer unit, a separation unit, a cleaning unit, and the like are sequentially arranged around a photosensitive drum body. In addition, this image forming apparatus includes a fixing unit for receiving a sheet from the separation unit. The units described above are selectively driven upon rotation of the photosensitive drum to perform the above image forming processes, thereby performing image formation.

The photosensitive drum, the developing unit, the fixing unit, and the like wear out over time, i.e., they are expendable. Replacement timings (life times) of these parts are determined in accordance with the frequencies of use. When the frequency of use of each part reaches a predetermined value, this part must be replaced with a new one. A corona wire of the charging unit and the like must be cleaned in accordance with a predetermined frequency of use. In order to perform the replacement of expendables and the cleaning operation of the corona wire and the like at optimal timings, a message representing a replacement or cleaning timing may be displayed on a display unit arranged in an operation panel to signal the need for replacement or cleaning to an operator.

Since the screen area of this display unit is generally small, such a message must be displayed with a symbol or short sentence. The operator, therefore may not accurately understand the content of the message. Even, if the operator understands the content of the message, he or she may not be familiar with replacement or cleaning procedures. In this case, an operation manual of this apparatus is prepared, and the operator performs replacement or cleaning in accordance with instructions described in this operation panel. It is, however, cumbersome to prepare the operation manual, find out a desired item, and read its contents. In addition, replacement or cleaning cannot always be performed immediately after the message is displayed, resulting in inconvenience. When replacement or cleaning is not performed at an optimal timing, the corresponding part may fail, and satisfactory image formation may not be performed.

When a copy count reaches a predetermined number, e.g., 5,000, a cleaning message for the corona wire is displayed. In this case, when image data from a host unit is being printed, the operator may misunderstand that printing of this image data must be interrupted. In addition, the operator may be afraid of degradation of printing quality.

SUMMARY OF THE INVENTION

The present invention has been made to solve conventional drawbacks wherein an operator cannot always accurately understand the meaning of a message indicating replacement of an expendable part, or the cleaning of a corona wire or the like. Even if the operator understands the content of the message, he or she often does not know the replacement or cleaning procedures. If this happens, the operator must prepare a printed operation manual of a target apparatus, find a desired item, and reads the content of this item, that is, if the above situation occurs, cumbersome operations such as preparation of the operation manual, finding of a desired item, and reading of the content of this item are required, and replacement or cleaning cannot be performed immediately after the message is displayed. It is therefore an object of the present invention to provide an image forming apparatus which does not require an operator to prepare a printed operation manual at the time of replacement of an expendable part, or cleaning of a corona wire or the like, which facilitates replacement or cleaning at optimal timings.

It is another object of the present invention to provide an image forming apparatus for outputting message upon completion of image formation when an image formation count reaches a predetermined value but when current image formation based on data already received from a heat unit has not yet been completed.

An image forming apparatus according to the present invention comprises memory means for storing message information, counting means for measuring an image formation count, readout means for reading out the message information from the memory means when the image formation count measured by the counting means reaches a predetermined value, converting means for converting the message information read out by the readout means into image information, and image forming means for forming an image according to the image information converted by the converting means.

According to the present invention, message information representing a replacement timing of an expendable, or a cleaning time, is stored in the memory means while the image formation count is measured. When the count of the counting mean reaches the predetermined value, the message information is read out from the memory means and is converted into image information. The charged photosensitive drum is exposed in accordance with the converted image information. Development, transfer, and fixing are sequentially performed to form a message information image on the transfer medium. The operator need not prepare the operation manual at the time of replacement of an expendable or cleaning of a corona wire or the like. The operator can perform replacement or cleaning operations in accordance with the message information image. Therefore, replacement of an expendable or cleaning, can be facilitated.

When the image formation count reaches the predetermined value during the execution of image formation based on already received data from host unit, the current image formation is preferentially performed. Upon completion of the image formation, a message is output to smoothly perform image formation and maintenance.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
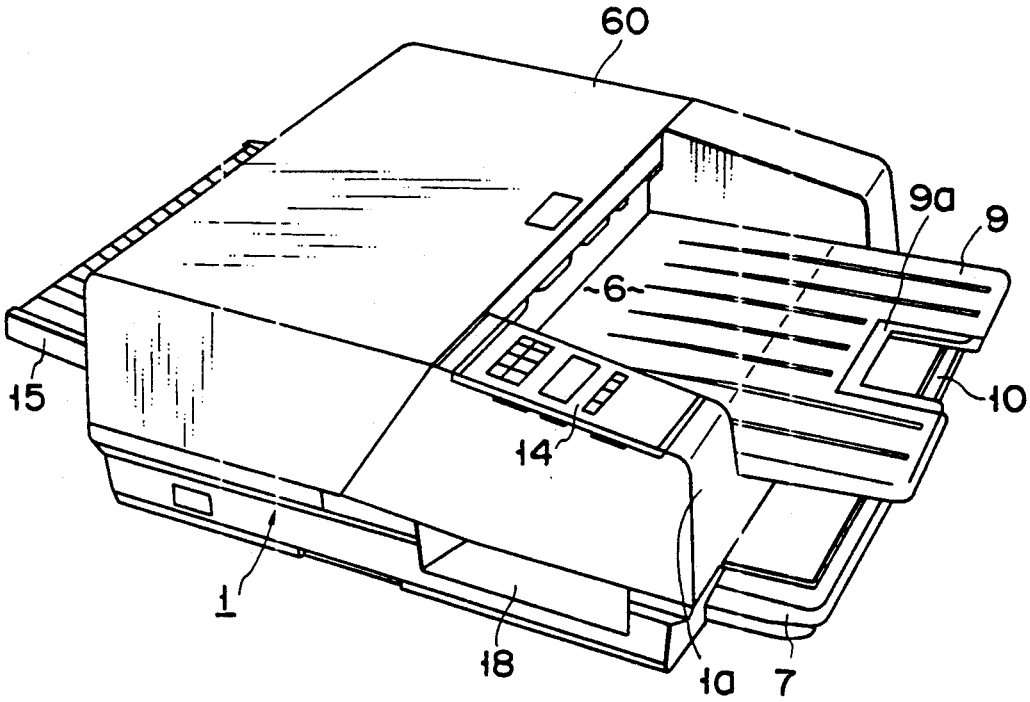
FIG. 1 is a perspective view showing an outer appearance of a laser printer to which the present invention is applied.
Figure 2:
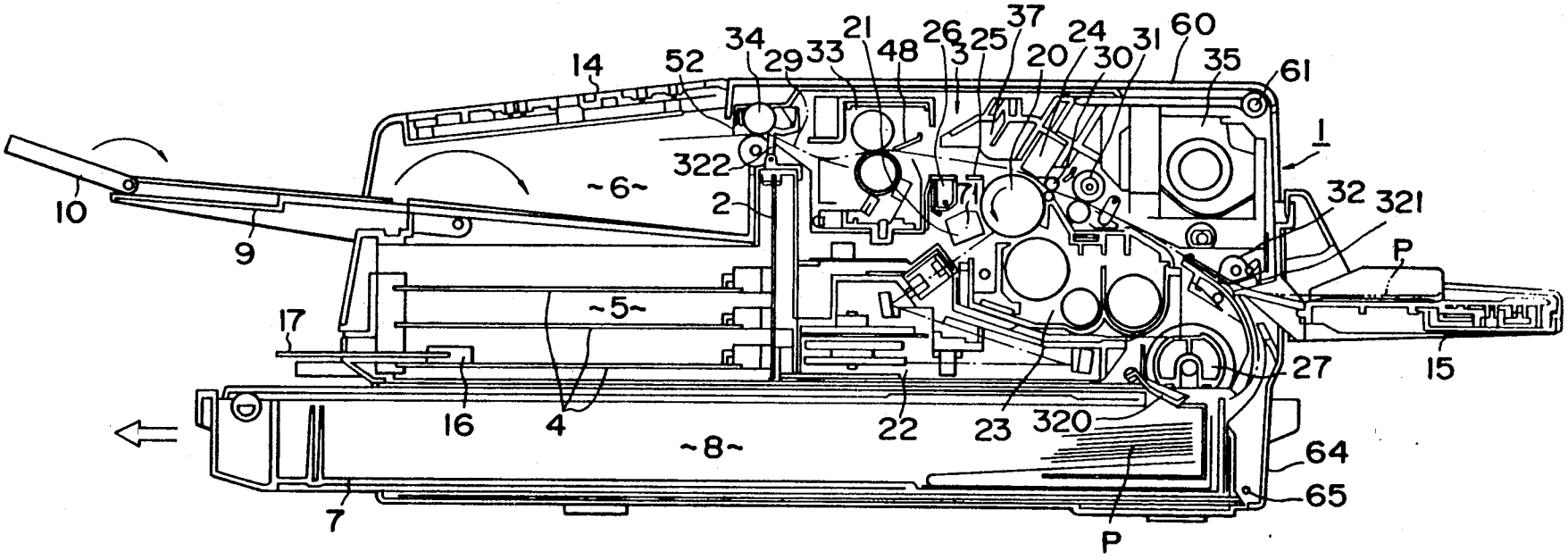
FIG. 2 is a side view showing an inner structure of the laser printer shown in FIG. 1.

A preferred embodiment of the present invention will be described in detail with reference to the accompanying drawings. FIG. 1 is a perspective view showing an outer appearance of a laser printer as an image forming apparatus according to the present invention. FIG. 2 is a schematic longitudinal sectional view showing the internal structure of the laser printer. The structure of the laser printer will be described below.

Figure 5:
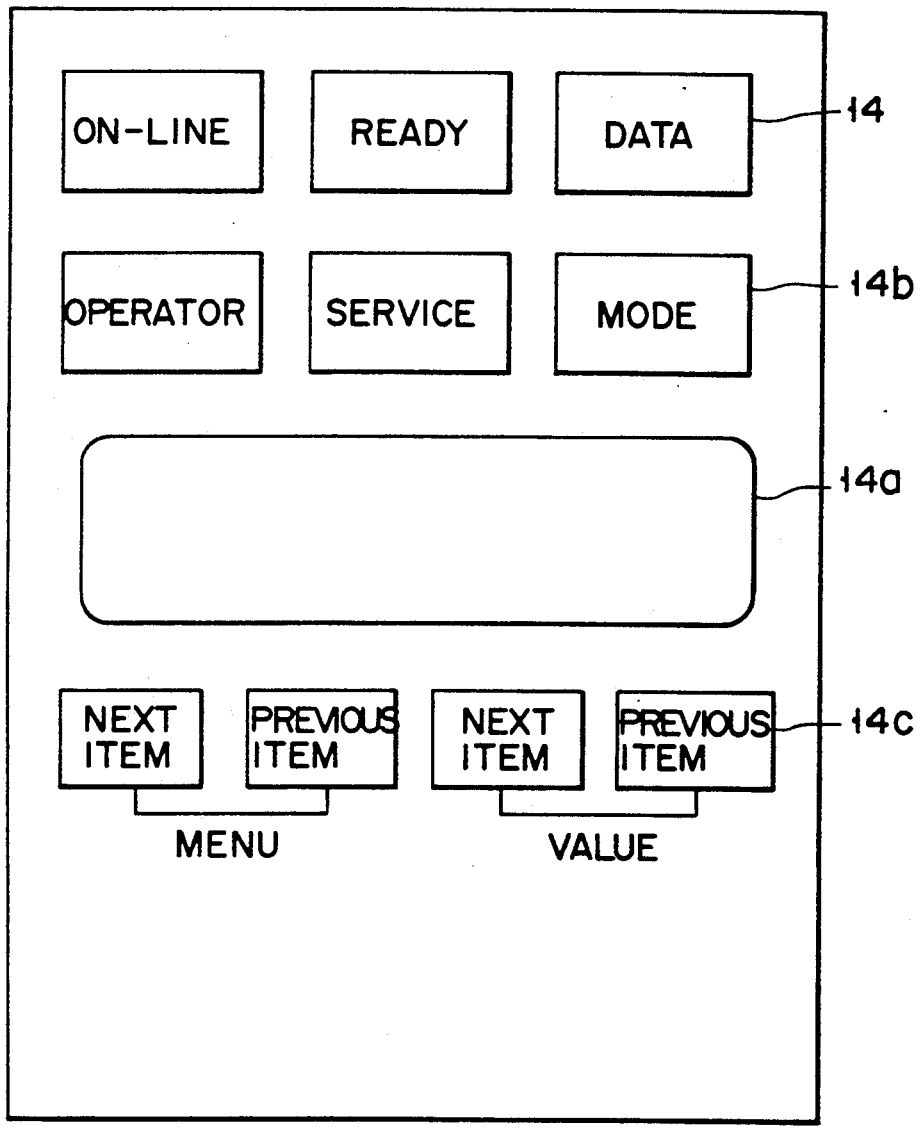
FIG. 5 is a plan view showing an arrangement of an operation panel.

Reference numeral 1 denotes a laser printer main body serving as an image forming apparatus, which has the following arrangement. A recess 6, serving as a paper discharge section, is formed on the upper surface of the main body 1. A rotatable discharge tray 9 is pivotally mounted at the front edge portion of the recess 6 so that the tray 9 can be folded in the recess 6 or unfolded to provide a large surface area. A notch 9*a*, shown in FIG. 1, is formed at the central portion of the front edge of the discharge tray 9. At the same time, a U-shaped rotatable auxiliary tray 10 may be folded back to notch 9*a* or unfolded to extend from the front edge of notch 9*a*, as shown in FIG. 2. The depth of the discharge section 6 can be adjusted in accordance with the size of a discharged sheet P. An operation panel 14, as shown in FIG. 5, is arranged on the upper surface of a left frame 1*a* of the main body 1 which is located on the left side of the recess 6. A paper cassette 7 for storing sheets is attached to the lower inner portion of the main body 1 so that the cassette 7 is inserted from the lower portion of the front surface of a cassette storage portion 8, as shown in FIG. 2. A manual tray 15 detachable from the main body 1 is mounted on the rear surface side of the main body 1.

As shown in FIG. 5, the operation panel 14 comprises a liquid crystal display unit 14*a* for displaying a copy count, a mode, a guide message, and the like, an LED display unit 14*b* for indicating various operating states with LEDs, and switches 14*c* for designating various operation modes. The LED display unit 14*b* comprises an "on-line" display element indicating whether the laser printer is connected to external equipment, i.e., representing an on-/off-line mode, a "ready" display element representing whether the main body 1 is ready for printing, a "data" display element representing that an image is being transferred, an "operator" display element for requesting an operator call, a "service" display element for requesting a service call, and a "mode" display element representing an auto/manual mode.

The switches 14*c* include, e.g., menu keys and value keys, or a ten-key pad (not shown). The menu keys are "next item" and "previous item" menu keys. Every time the "next item" menu key is depressed, a plurality of pieces of menu information displayed on the left half of the liquid crystal display unit 14*a* are incremented. However, upon every depression of the "previous item" menu key, these pieces of information are decremented. These display operations are cyclically repeated. The value keys are "next item" and "previous item" value keys. Every time the "next item" value key is depressed, a plurality of pieces of value information corresponding to the pieces of menu information displayed on the left half of the liquid crystal display unit 14*a* are incremented. Upon every depression of the "previous item" value key, the pieces of information are decremented, and the decremented values are displayed on the right half of the liquid display unit 14*a*. These display operations are cyclically repeated. The operator selects a desired operation upon operations of the menu and value keys, thereby designating the desired operation.

A drum-like photosensitive drum 20 serving as an image carrier is arranged inside the main body 1, as shown in FIG. 2. A charging unit 21 consisting of a SCOROTRON, an exposure element 22*a* of a laser exposure unit 22 serving as an electrostatic latent image forming means, a magnetic brush type developing unit 23 for simultaneously performing a developing process and a cleaning process, a transfer unit 24 consisting of a SCOROTRON, a memory erase unit 25 consisting of a brush member, and a pre-exposure unit 26 (not shown in detail) are sequentially arranged around the photosensitive body 20 along its rotational direction. Of these components, the photosensitive body 20, the charging unit 21 (having a charging wire 71), the developing unit 23, and the memory erase unit 25 are arranged as a single electrophotographic process unit detachable from the main body 1.

A sheet convey path 29 is formed in the main body 1, to extend through an image transfer portion 28 formed between the photosensitive body 20 and the transfer unit 24. A sheet P automatically fed from the cassette 7 through a feed roller 27, or a sheet P manually fed along the manual tray 15 is guided to the image transfer portion 28 along the sheet convey path 29. A paper empty switch 320 for detecting sheets P inside the cassette 7 is arranged near the feed roller 27. A manual switch 321 for detecting the manually fed sheet P is arranged near a convey roller pair 32.

A convey roller pair 30, an aligning roller pair 31, and the convey roller pair 32 are arranged at the upstream side of the image transfer portion 28 on the sheet convey path 29. A fixing unit 33 and a discharge roller unit 34 are arranged at the downstream side of the image transfer portion 28. The discharge roller unit 34 comprises a lower roller and an upper roller. A discharge brush, which is brought into contact with an image non-formation surface of the sheet P, is arranged in the convey direction of the discharge roller unit 34. A cooling fan 35 is arranged above the convey roller pair 32. A convey guide 37 is arranged above the image transfer portion. An aligning switch is arranged near the aligning roller pair 31. A discharge switch 322 is arranged near the discharge roller unit 34 to detect the sheet P. An engine control board having an engine control circuit 2 for controlling the respective electric components arranged inside the main body 1 and controlling the photoelectric processes is arranged below the charge roller unit 34. At the same time, a board having a printer control circuit 4 for controlling the operation of the engine control circuit 2 is arranged in a board storage section 5 arranged in the front portion of the main body 1.

A maximum of three printer control boards 4 can be used in accordance with the number of functions (e.g., memory extension for fonts and types of kanji). In addition, function addition IC cards 17 can be inserted into three IC card connectors 16 located at the front edge of the lowermost printer control board 4, thereby further increasing the number of functions. A connector (not shown) for connecting the laser printer to a host unit, 409 (FIGS. 6 and 8) as an external output unit such as a computer or a word processor, is arranged at the left end portion of the lowermost printer control board 4. The connector is located to oppose an opening 18 formed at the left side surface of the main body 1, as shown in FIG. 1.

An openable top cover 60 is mounted on an upper surface opening portion 3 of the main body 1. The transfer unit 24, the convey guide 37, and the discharge brush 52 are included inside the top cover 60, and the upper roller of the discharge roller unit 34 is mounted together with the above components. The top cover 60 can be pivoted about a support shaft 61 as a pivot shaft mounted at the upper portion of the rear end of the main body 1 through a maximum of about 120°.

When the top cover 60 is pivoted upward, the upper roller is removed from the opening portion 3 together with the transfer unit 24, the convey guide 37 and the discharge brush 52. Therefore, most of the sheet convey path 29, and most of the components of the electrophotographic process unit facing the sheet convey path 29 are exposed. Therefore, a jammed sheet P can be easily removed, and maintenance and inspection of the above components and their replacement is also facilitated.

A rear cover 64 (FIG. 2) of the main body 1 can also be opened or closed through a support shaft 65. The start end portion of the sheet convey path 29, i.e., an arcuated convey portion for guiding the sheet P picked up by the feed roller 27 can be opened. Therefore, a sheet P jammed in this portion can easily be removed.

In image formation, the drum-like photosensitive body 20 is rotated, while the surface potential of the photosensitive body 20 is kept constant by the behavior of the pre-exposure unit 26. The photosensitive body 20 is scanned and exposed with a laser beam a by the laser exposure unit 22, and an electrostatic latent image corresponding to an image signal is formed on the photosensitive body 20. The latent image on the photosensitive body 20 is developed by the developing unit 23 using a two-component developing agent consisting of a toner and a carrier. The developed latent image as a toner image is guided to the image transfer portion.

The sheet P picked up from the cassette 7 or the manual tray 15 is fed through the aligning roller pair 31 in synchronism with a toner image forming operation. The toner image formed on the photosensitive body 20 by the above operation is transferred by the behavior of the transfer unit 24 to the sheet P guided along the convey guide 37. The sheet P is then guided along the convey guide 37 and is conveyed into the fixing unit 33 through the sheet convey path 29. The toner image is then melted and fixed on the sheet P. Thereafter, the sheet is discharged to the discharge section 6 through the discharge roller unit 34.

After the toner image is transferred onto the sheet P, the residual toner left on the photosensitive body 20 is electrostatically attracted by the memory erase unit 25 consisting of a conductive brush and is uniformly distributed on the surface of the photosensitive body 20. The residual toner particles are then mechanically or electrostatically removed by the developing unit 23.

Now, the structure of a laser printer having an electrophotographic process unit formed as a process cartridge will be described by referring to FIGS. 3 and 4. This process cartridge is a unit combined with a photosensitive drum and at least one process means functioning to the drum. The process cartridge has a structure capable of being mounted detachably with respect to the image forming apparatus body.

Figure 3:
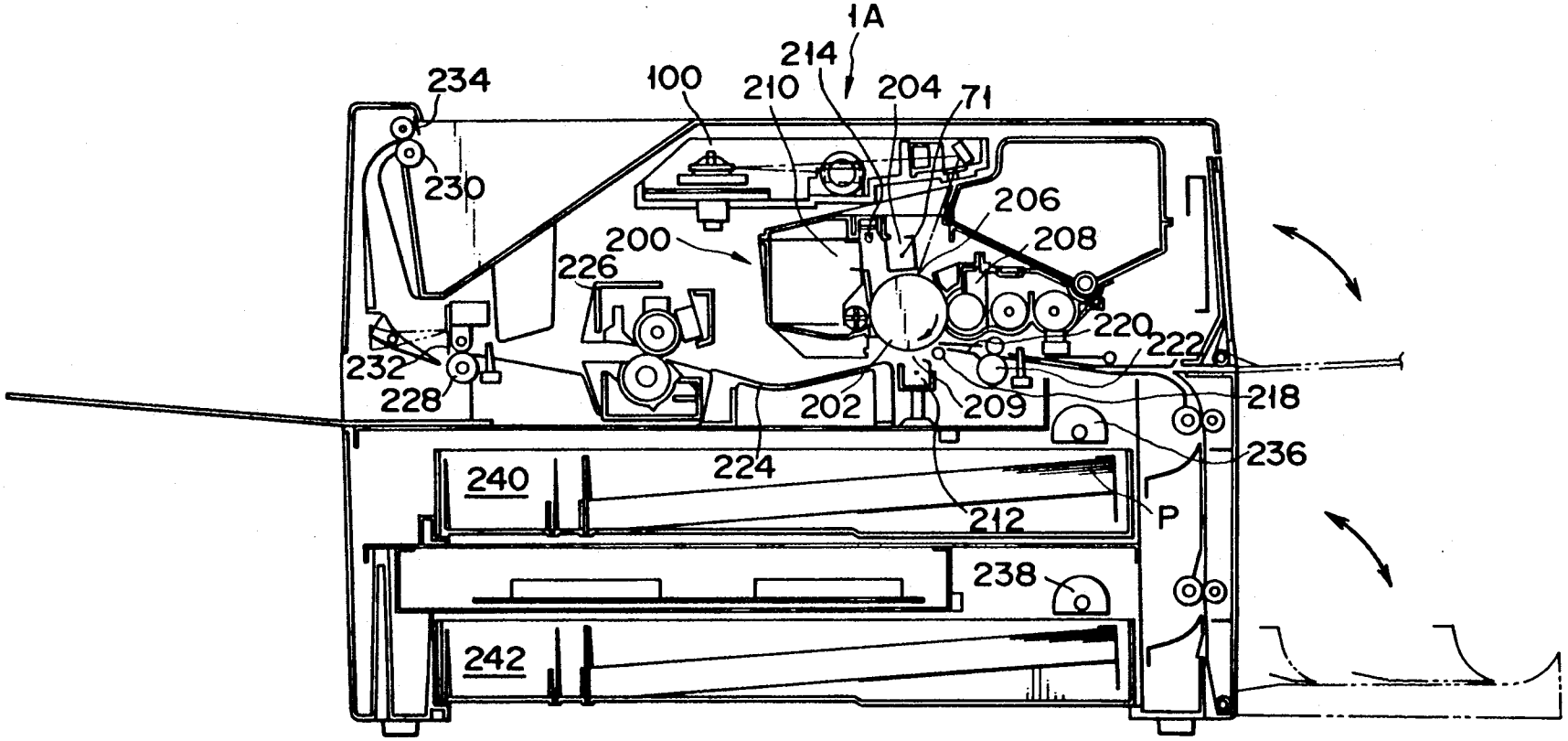
FIG. 3 shows an inner structure of a modified laser printer in which an electrophotography process unit including a photosensitive drum shown in FIG. 2 is integrally formed as a single cartridge.

As shown in FIG. 3, an image carrier, i.e., a photosensitive drum 202 is provided in an electrophotographic process unit 200 formed as a process cartridge type. The unit 200 is mounted in the apparatus body 1A. A charging unit 204 containing a SCOROTRON, an exposure unit 206 functioning as an electrostatic latent image forming means, a developing unit 208 for performing an image developing process, an image transfer unit 212 composed of a COROTRON, a drum cleaner unit 210, and a pre-exposure unit 214 are arranged around the photosensitive drum 202 in the order mentioned in the direction shown by an arrow. Of these units, the photosensitive unit 202, charging unit 204, developing unit 208, drum cleaner unit 210, and pre-exposure unit 214 are formed integrally as an electrophotographic process unit 200 which is detachably mounted to the apparatus body 1A as shown in FIG. 4.

An image transfer section 209 is provided between the photosensitive body 202 and the image transfer unit 212 in the apparatus body 1A. An image transfer guide roller 218, a paper guide 220, and an aligning roller pair 222 are provided at the upstream side of the image transfer section 209.

At the downstream side of the image transfer section 209, a paper transfer guide 224, a fixing unit 226, a first paper discharging roller pair 228, and a second paper discharging roller pair 230 are provided in the order mentioned. Discharging brushes 232 and 234 contacting the non-image forming side of the paper P are provided at the paper discharging roller pairs 228, 230 in the paper feeding direction.

Paper feeding rollers 236 and 238, and paper cassettes 240 and 242 are provided at the lower part of the apparatus body 1A. Paper empty switches (not shown) for detecting the paper P in the paper cassettes 240 and 242 are provided near the paper feeding rollers 236 and 238. Paper size detecting switches (not shown) for detecting the sizes of the paper P in the cassettes 240 and 242 are provided at the side plates of the cassette cases. Load-detecting switches for detecting the fact that the paper cassettes 240 and 242 are loaded in the apparatus body 1A are also mounted at the side plates of the cassette cases.

Figure 4:
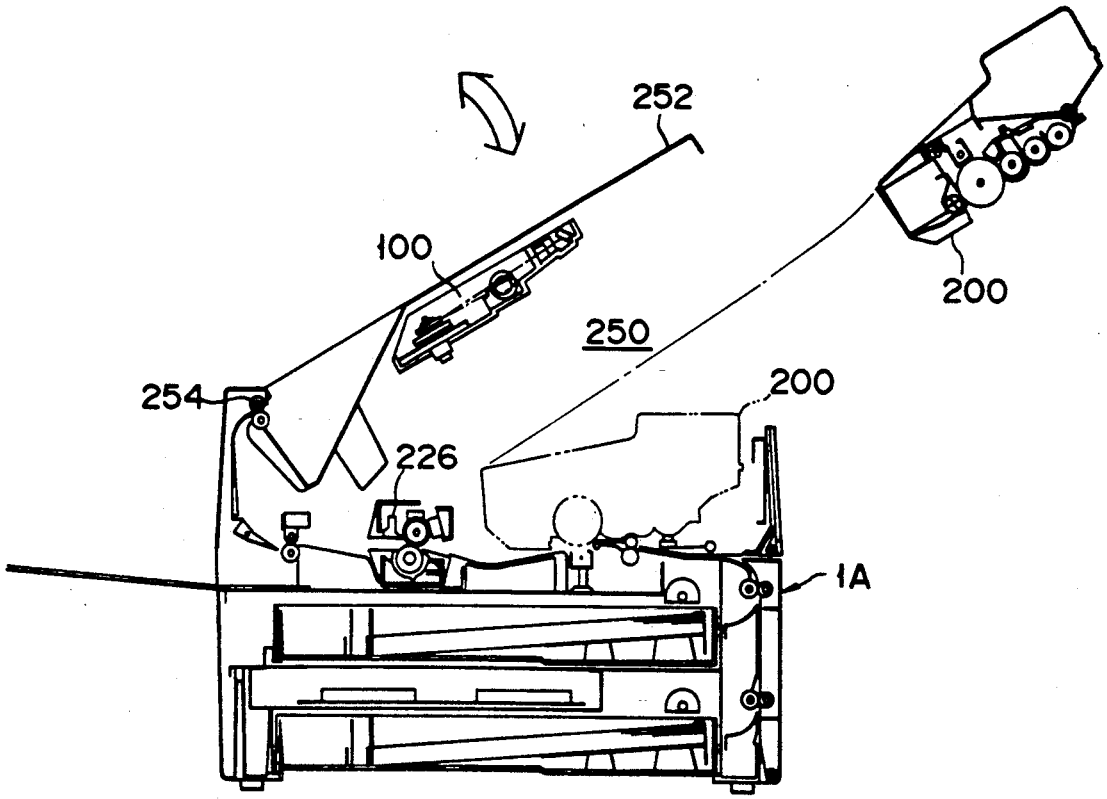
FIG. 4 is a side view showing a state in which the electrophotography process unit of FIG. 3 is removed from the laser printer body.

As shown in FIG. 4, an opening and closing top cover 252 is mounted at an opening section at an upper portion of the apparatus body 1A. A laser exposure unit 100 is provided at an inner side of the top cover 252. The top cover 252 is pivoted by pivots 254 provided at the rear upper portion of the apparatus body 1A so that the top cover 252 can be opened at the maximum of 60 degrees in the upper direction of the apparatus body 1A. When the top cover 252 is rotated in the upper direction, the process cartridge 200 can be removed from the opening portion 250 of the body 1A as shown in FIG. 4. Therefore, the fixing unit 226 and the paper travelling path near the fixing unit 226 are exposed in the opening portion 250, thereby enabling the exchanging operation of the electrophotographic process unit 200, jam-removing operation for the jammed paper P and the maintenance operations of the various units very easily and effectively.

The arrangement of the engine controller will be described below.

Figure 6:
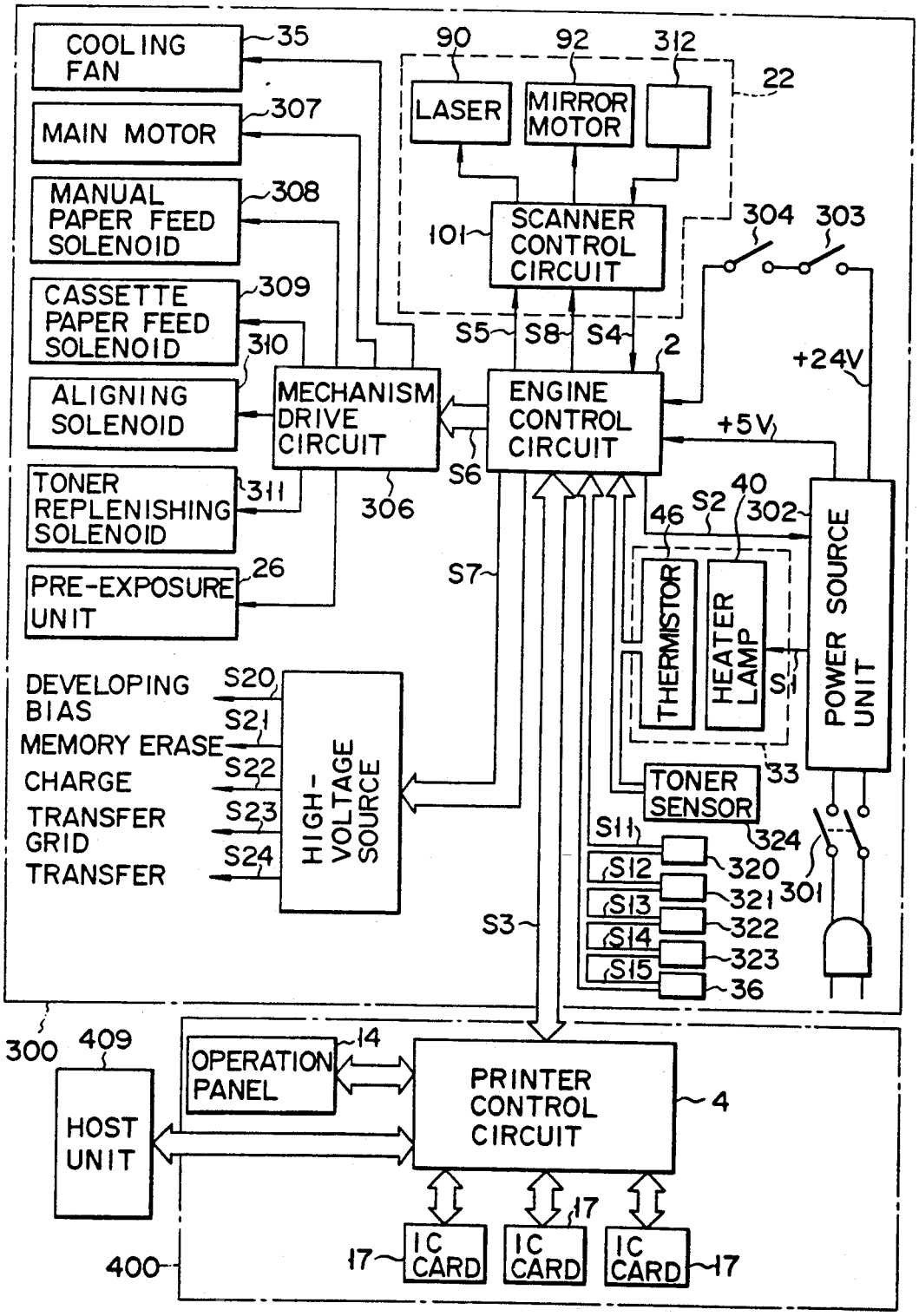
FIG. 6 is a block diagram showing an electric structure of the laser printer shown in FIG. 1.

FIG. 6 is a block diagram showing an arrangement of the main part of the engine controller 300. Referring to FIG. 6, reference numeral 302 denotes a power source unit. When a main switch 301 is turned on, power source voltages of +5 V and +24 V are output. The power source voltage of +5 V is applied to the engine control circuit 2 and to the printer control circuit 4 through the engine control circuit 2. On the other hand, the power source voltage of +24 V is supplied to the engine control circuit 2 through cover switches 303 and 304. The power source voltage of +24 V is supplied to the scanner control circuit 101, the high voltage source 305, and a mechanism drive circuit 306 through the engine control circuit 2. The voltage is applied from the scanner control circuit 101 to the semiconductor laser 90 and the mirror motor 92, from the mechanism drive circuit 306 to the exposure unit 26, the main motor 307, a cassette paper feed solenoid 308, a manual paper feed solenoid 309, an aligning solenoid 310, a toner replenishing solenoid 311, and the cooling fan 35. Therefore, the power source voltage is used for drive power sources of the above components.

A zero crossing switch type heater lamp drive circuit (not shown), consisting of a phototriac coupler and a triac, is arranged in the power source unit 302 to drive the heater lamp 40 in the fixing unit 33. The power source voltage of +24 V is used for a light-emitting LED of the phototriac coupler. In the heater lamp drive circuit having the above arrangement, it is known that when the light-emitting LED is turned on/off, the light-emitting phototriac is turned on/off at a zero crossing point of the AC power source. The triac serving as the main switch element in the next stage is turned on/off to connect or disconnect an AC power source S1 to the heater lamp 40. A heater control signal S2 for turning on/off the light-emitting LED is supplied from the engine control circuit 2 to the power source unit 302. At the same time, a temperature signal detected by the thermistor 46 arranged in the fixing unit 33 is supplied to the engine control circuit 2.

The cover switch 303 is turned off upon upward pivotal movement of the top cover 60. The cover switch 304 connected in series with the switch 303 is turned off when the rear cover 64 is open. When the top cover 60 or the rear cover 64 is open, the power source voltage of +24 V is interrupted by the switch 303 or 304. Therefore, the operations of the semiconductor laser 90, the mirror motor 92, the high voltage source 305, the main motor 307, the solenoids 308 to 311, the cooling fan 35, and the heater lamp 40 are stopped. No problem occurs even if the operator touches the internal components inside the main body 1.

Figure 7:
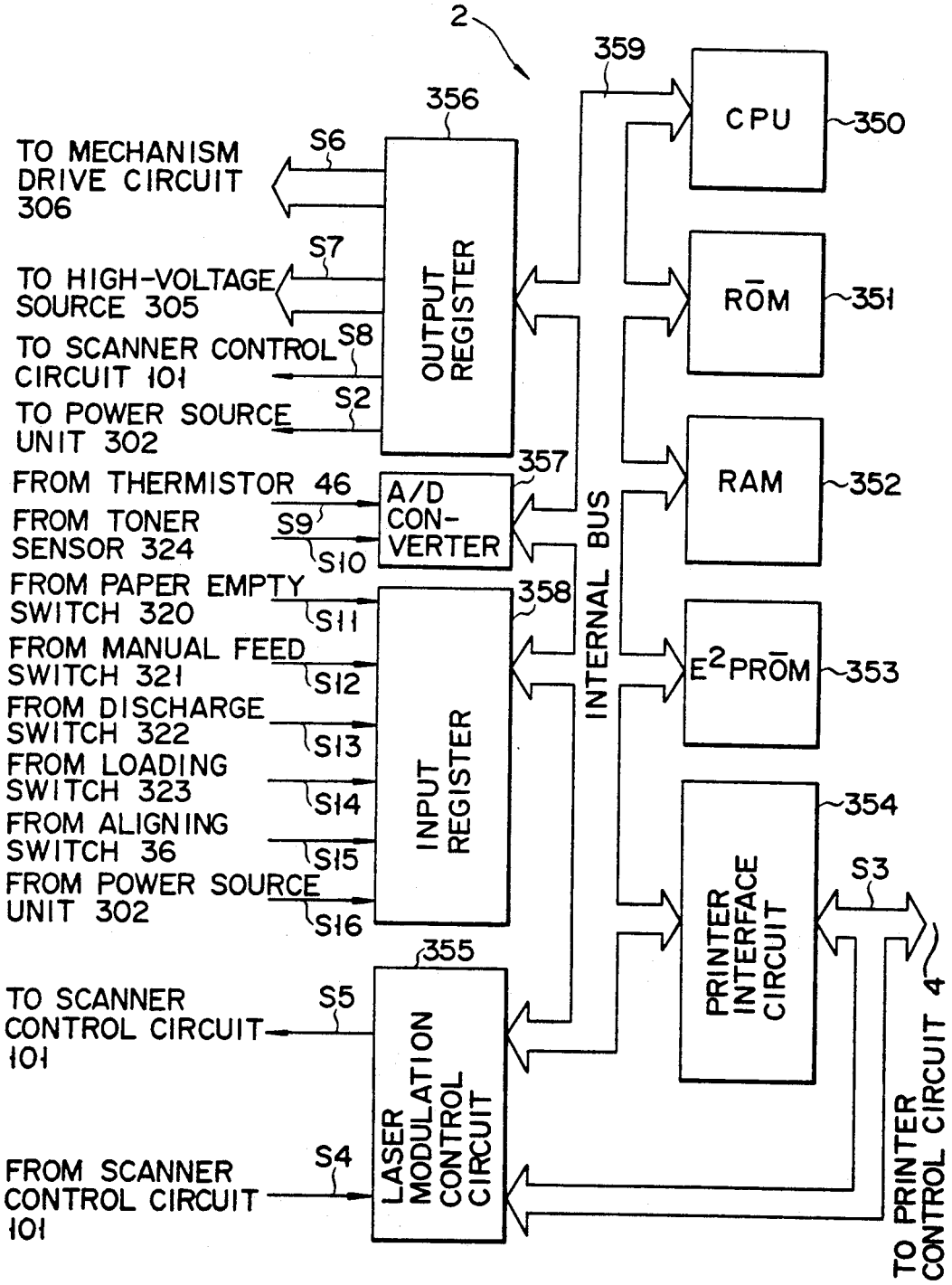
FIG. 7 is a block diagram showing a structure of an engine control circuit of FIG. 6.

FIG. 7 is a block diagram showing an arrangement of the engine control circuit 2. Referring to FIG. 7, a CPU 350 controls the overall operation of the engine controller 300 and is operated in accordance with control programs stored in a ROM 351. A RAM 352 is used as a work buffer for the CPU 350. An $E^2$PROM 353 stores a total print count, and a total image formation count of the electrophotographic process unit 85, i.e., a count after the electrophotographic process unit 85 is replaced with a new one. A printer interface circuit 354 exchanges an interface signal S3 with the printer control circuit 4. A laser modulation control circuit 355 controls the periodic turning on of the semiconductor laser 90, so as to generate a laser beam detection signal S4 (to be described later), and controls the modulation of the semiconductor laser 90 in accordance with image data sent from the printer control circuit 4 in response to the interface signal S3. The laser modulation control circuit 355 outputs a laser modulation signal S5 to the scanner control circuit 101. An output register 356 outputs control signals S6, S7, S8 and S2 for controlling the mechanism drive circuit 306, the high voltage source 305, the scanner control circuit 101, and the heater lamp drive circuit, respectively. An A/D converter 357 receives voltage signals S9 and S10 generated by the thermistor 46 and a toner sensor 324 and converts analog values into digital values. An input register 358 receives state signals S11, S12, S13, S14, and S15 from a paper empty switch 320, a manual feed switch 321, a discharge switch 322, the loading switch 323, and the aligning switch 36 and a +24 V ON/OFF state signal S16. An internal bus 359 exchanges data between the CPU 350, the ROM 351, the RAM 352, the, EEPROM 353, the printer interface circuit 354, the laser modulation control circuit 355, the output register 356, the A/D converter 357, and the input register 358.

A drive circuit for driving various motors and various solenoids is arranged in the mechanism drive circuit 306. The ON/OFF operation of the mechanism drive circuit 306 is controlled by a binary control signal S6 output from the output register 356. More specifically, when the control signal S6 is set at logic "1", each drive circuit is turned on. However, when the control signal S6 is set at logic "0", each drive circuit is turned off. The power source voltage of +24 V is supplied to or cut off from the pre-exposure unit 26, the main motor 307, the solenoids 308 to 311, and the cooling fan 35. Drive circuits for the semiconductor laser 90 and the mirror motor 92 are arranged in the scanner control circuit 101. The ON/OFF operation of the semiconductor laser 90 is controlled in response to the laser modulation signal S5 output from the laser modulation control circuit 355. The ON/OFF operation of the mirror motor 92 is controlled in response to the control signal S8 output from the output register 356. A PIN diode is used in the laser beam sensor 312. A current proportional to optical energy obtained upon passing of the laser beam through the laser beam sensor 312 flows through the PIN diode. This current signal is supplied to the laser modulation control circuit 355 as the laser beam detection signal S4. The high voltage source 305 applies a developing bias voltage signal S20, a memory erase voltage signal S21, a charging voltage signal S22, a transfer grid voltage signal S23, and a transfer voltage signal S24 to the voltage bias power supply unit 140, the memory erase unit power supply unit 141, the charging unit power supply unit 142, the grid voltage power supply unit 197 of the transfer unit 24, and the wire high voltage power supply unit 198, respectively. The ON/-OFF operations of these components are controlled in response to the control signal S7 output from the output register 356.

An appropriate voltage is applied to each electric circuit through the engine control circuit 2 in the engine controller 300, as described above. At the same time, the respective components are controlled in response to the binary control signals output from the engine control circuit 2. The engine controller 300 is connected to a printer controller 400 (to be described later) through the interface signal S3.

An arrangement of the printer controller 400 will be described below.

Figure 8:
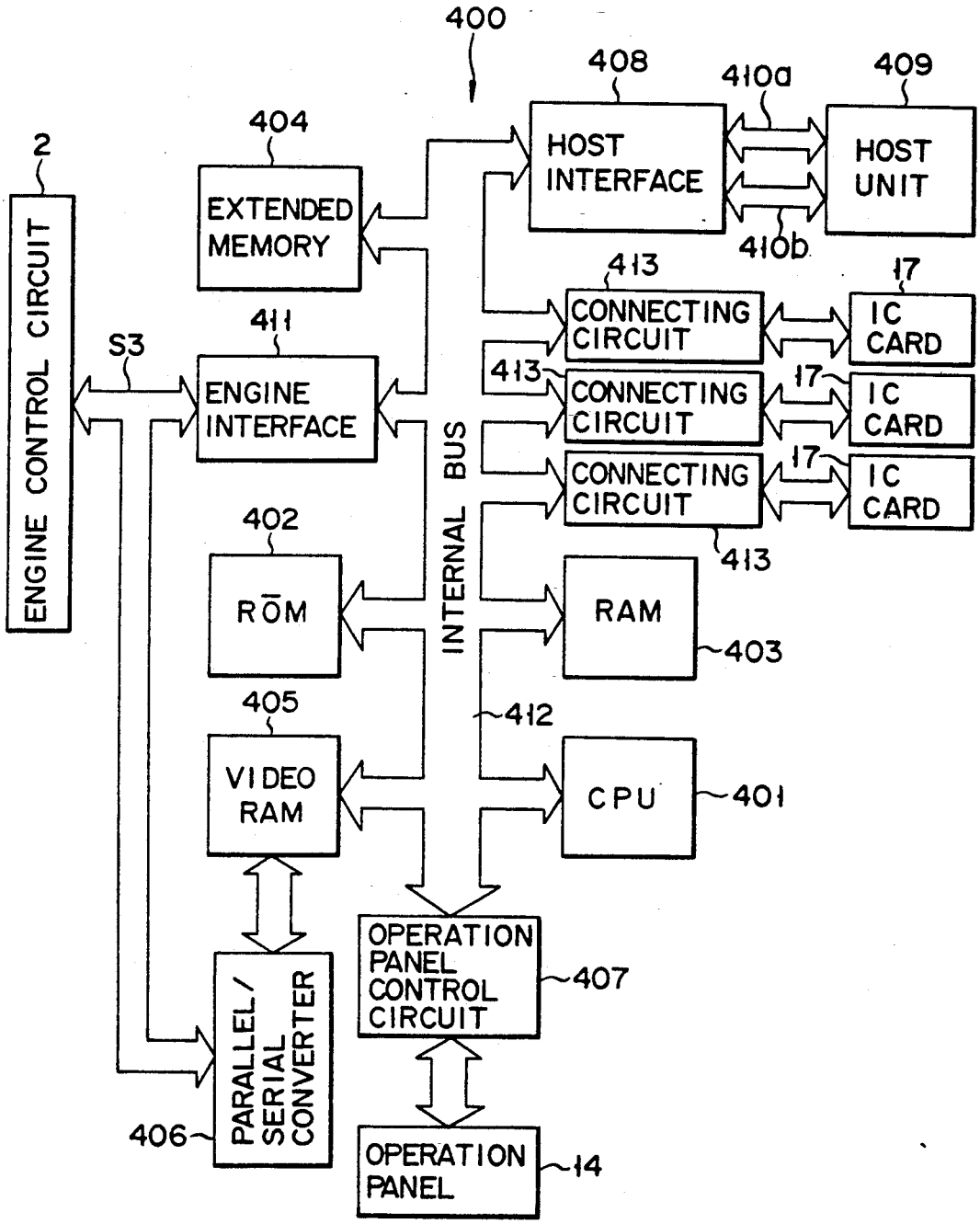
FIG. 8 is a block diagram showing a structure of the printer control circuit of FIG. 6.

FIG. 8 is a block diagram showing an arrangement of the main part of the printer controller 400. Referring to FIG. 8, a CPU 401 performs the overall control of the printer controller 400. A ROM 402 stores a control program. The CPU 401 is operated in accordance with this control program. The ROM 402 stores a password collated at the time of data updating, data associated with the sheets P, such as top margin data, left margin data, and paper type data, and message information for signaling a message to an operator. A RAM 403 is used as a page buffer for temporarily storing image data sent from the host unit 409. An extended memory 404 is a large-capacity memory used when one-page data cannot be stored in the RAM 403 because the image data sent from the host unit 409 contains a large amount of data, such as bit map data. A video RAM 405 stores image data developed into a bit image. An output from the video RAM 405 is supplied to a parallel/serial converter 406. The parallel/serial converter 406 converts into serial data the image data developed as a bit image and sent as parallel data. The serial data is supplied from the parallel/serial converter 406 to the engine control circuit 2.

A host interface 408 interfaces data exchange between the host unit 409 such as a computer or an image reader and the printer controller 400. The host interface 408 has a serial transfer line **410*a* and a parallel transfer line 410*b*. These transfer lines can be selectively used in accordance with the type of data transferred from the host unit 409. An engine interface 411 interfaces exchange of the interface signal S4 between the printer control circuit 4 and the engine control circuit 2. Connecting circuits 413*a*, 413*b*, and 413*c* are used to disconnect the power sources and signal lines from IC cards 17*a* to 17*c* to prevent data stored in the IC cards 17*a* to 17*c* from destruction due to noise generated when the IC cards 17*a* to 17*c* are inserted into or removed from the connectors 16**.

An operation panel control circuit 407 controls display of a guide message on the liquid crystal display element **14*a* of the operation panel 14, to turn on, turn off, or flicker the LED display element 14*b*, and sends data input from the switch 14*c* to the CPU 401. An internal bus 412 allows data exchange between the CPU 401, the ROM 402, the RAM 403, the extended memory 404, the video RAM 405, the operation panel control circuit 407, the host interface 408, the engine interface 411, and the connecting circuit 413**.

The IC cards **17*a* to 17*c* may comprise nonvolatile memories such as battery-backed static RAMs, E2-PROMs, EPROMs, or mask ROMs. These IC cards 17*a* to 17*c*** store character fonts, emulation programs, and the like.

Figure 9:
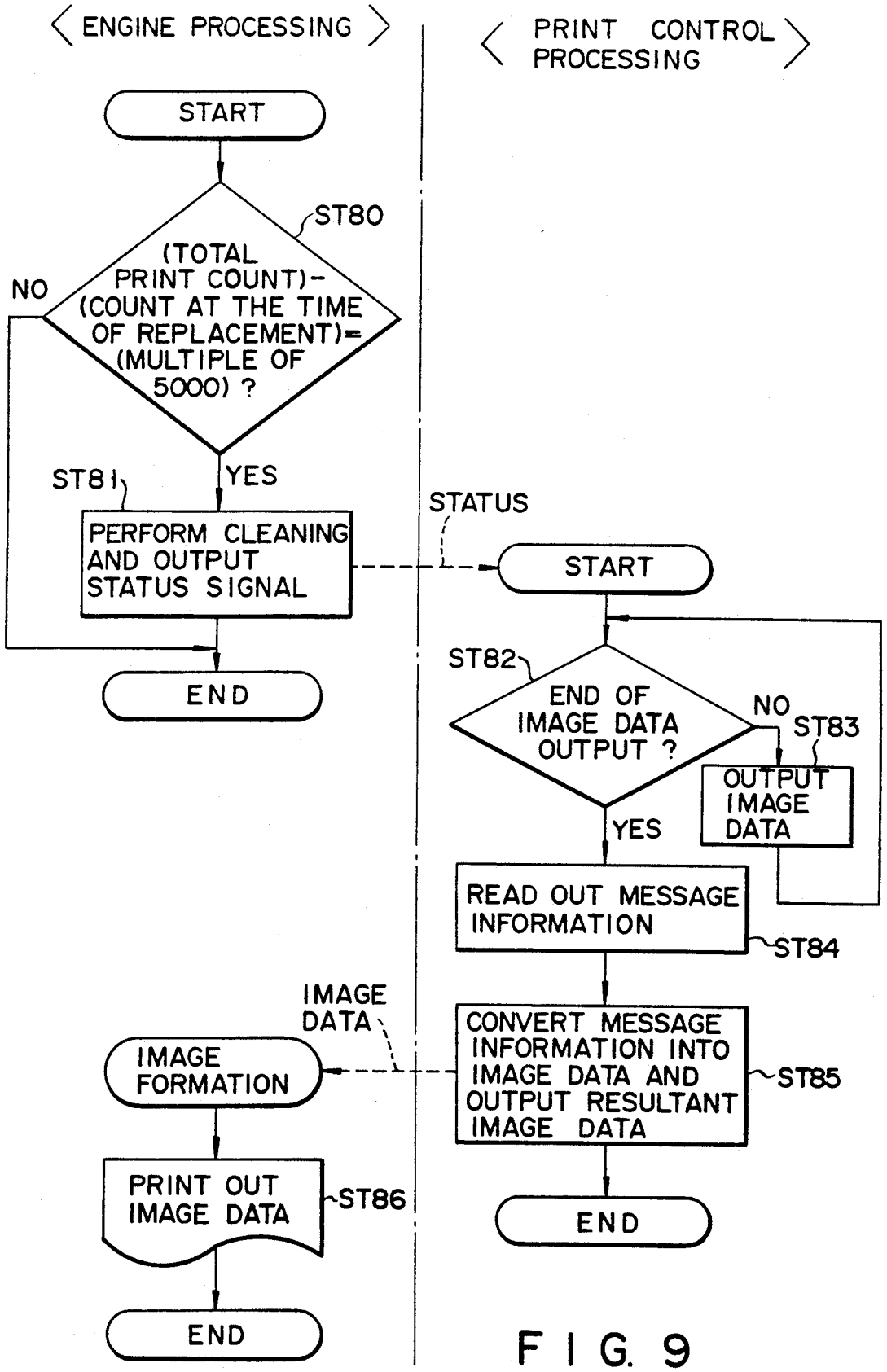
FIG. 9 is a flow chart showing an operation of the laser printer when a charger wire thereof is being cleaned.

Printing of the content of a message required for maintenance, e.g., cleaning of a corona wire or the like as a characteristic feature of the present invention will be described with reference to FIGS. 9 to 11.

The corona wire 71 of the charging unit 21 shown in FIGS. 2 and 3 is arranged to always obtain a high-quality image by cleaning it every time 5,000-sheet of printing are completed. The cleaning of the charging unit 21 must be performed every time 5,000 sheets are printed. In order for the operator to perform this cleaning, the laser printer of this embodiment has the following message output functions.

A technique for managing a print count will be described below. A print count is stored in a count area (not shown) assigned as a predetermined area in an $E^2$PROM 353 connected to the CPU 350 of the engine controller circuit 2. The contents of the $E^2$PROM 353 are not lost even if the power switch is turned off. Therefore, a cumulative print count from the installation time of the laser printer to the present moment can be done. The print count stored in the count area of the $E^2$PROM 353 is incremented every time one sheet is printed.

A print count measured at the time of the previous cleaning (to be referred to as a replacement print count hereinafter) is stored in a save area (not shown) assigned in another predetermined area of the $E^2$PROM 353.

The engine controller circuit 2 subtracts the replacement print count stored in the save area from the print count stored in the count area of the $E^2$PROM 353. The CPU 401 determines whether a difference is a multiple of 5,000 (step ST80). Since the cleaning cycle is needed once every 5,000 sheets, if a difference between the print count and the replacement print count is a multiple of 5,000, a cleaning operation is required. This determination is performed at the end of the series of printing operations of the engine controller 300 (to be described in detail later).

When the CPU 401 determines in step ST80 that the difference is a multiple of 5,000 and that a cleaning operation is required, a status signal representing a requirement of cleaning, i.e., a cleaning status signal of the operator call is output from the engine control circuit 2 (step ST81). The CPU 401 determines whether a cleaning operation is required, and the process is terminated. If the CPU 401 determines in step ST80 that the difference is not a multiple of 5,000, process is also terminated.

When the printer control circuit 4 receives the cleaning status signal, the CPU 401 determines whether the image data received from the host unit 409 is output to the engine controller 300 (step ST82). If NO in step ST82, i.e., when the CPU 401 determines that image data output processing is not ended, image data output processing is executed (step ST83), and the operations in steps ST82 and ST83 are executed. The CPU 401 then waits until all the image data are output. In this state, when the CPU 401 determines the end of image data output in step ST82, message information representing a cleaning operation sequence is read out from the ROM 42 (step ST84). This message information is stored as code information in the ROM 402.

The message information as the code information read out from the ROM 402 is converted into image data as a character image, and the character image is output to the engine controller 300 (step ST85). A description for processing in step ST85 will be omitted since it is the same as processing for converting the data received from the host unit 409 into image data of the character image and outputting the converted image data to the engine controller 300.

Figure 10:
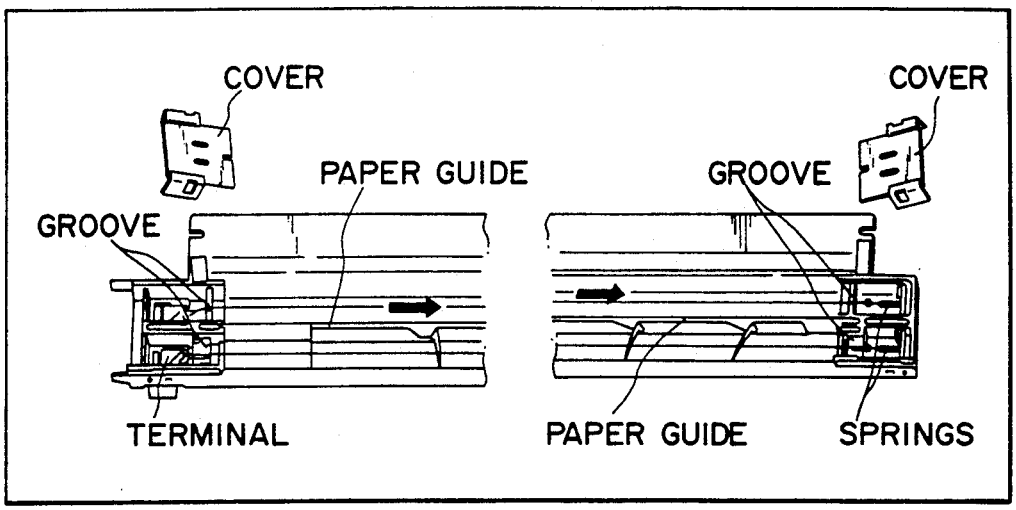
FIG. 10 shows a maintenance operation manual printed as a message for showing the method of cleaning the charger wire.
Figure 11:
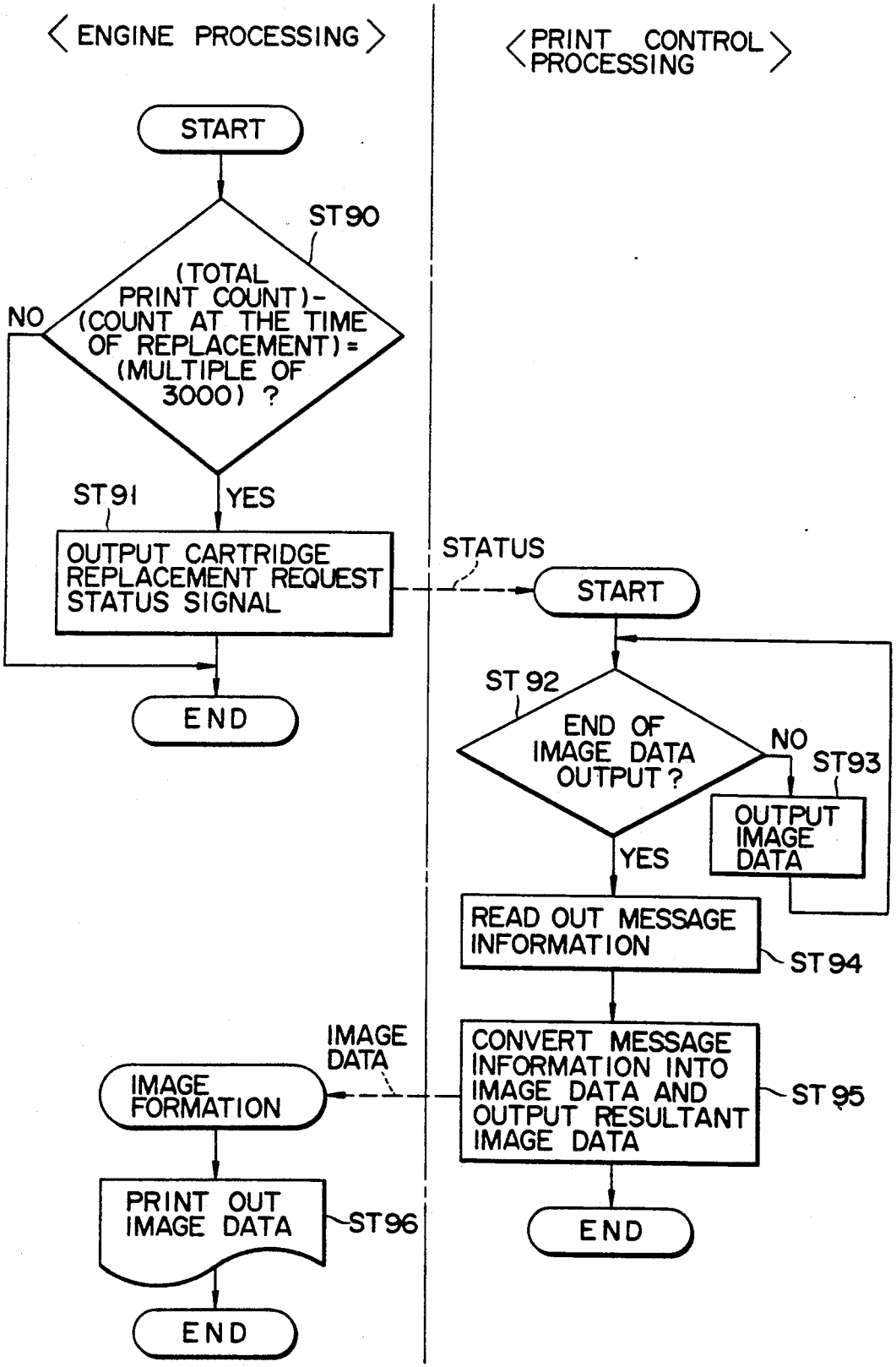
FIG. 11 is a flow chart showing an operation of the laser pointer when a process cartridge is being replaced.

The engine controller 300 which receives the above image data performs printing processing, and a document representing the cleaning operation sequence as shown in FIG. 10 is printed and output (step ST86). In this case, a message requesting the cleaning of a charging wire is printed out. For example, this message is printed on a sheet of paper in such a manner as "The print count has reached 5000. Please clean the charging or corona wire by referring to the printed manual."

The operator easily performs cleaning operations of the corona wire 71 in accordance with the procedures described in the printed matters of the manual.

As described above, the maintenance manual message information to be output at a cleaning timing is stored in the ROM 402 while the print count is stored in the count area of the $E^2$PROM 353. The message information is read out from the ROM 402 when the count area of the $E^2$PROM 353 counts a predetermined value. The readout image information is converted into image data, and the charged photosensitive body 20 (or 202) is exposed to light in accordance with the converted image data. The latent image is then developed, transferred, and fixed, thereby printing the message information on the sheet P. The operator can easily perform cleaning with reference to the printed message information without using the maintenance manual at the time of cleaning.

The cleaning operation sequence is automatically printed at the time of cleaning. Any user can easily perform cleaning. In addition, when image output continues even when the image formation count reaches a predetermined value, a message is output after the present printing operation is completed. Therefore, the operator is not confused with the message or does not feel anxiety.

In the above embodiment, processing for outputting a message for designating cleaning of the corona wire 71 in the charging unit 21 is exemplified. However, the present invention is also applicable to the cleaning of other apparatuses. Moreover, the operation is not limited to cleaning, but can be extended to output a message for replacing expendables such as the process cartridge 200 of FIG. 4, thereby obtaining the same effect as in the above embodiment. FIG. 11 shows a flow chart of replacing a process cartridge 200 of FIG. 4 when the print count reaches 3000, counted since the current process cartridge was inserted. In the figure, when a difference, (TOTAL PRINT COUNT)—(COUNT AT THE TIME OF REPLACEMENT) is a multiple of 3000 at the step ST90, the operation advances to the next step ST91, where a cartridge replacement request status signal is read out.

When the printer control circuit receives the status signal, the CPU determines whether the image data output processing is ended at steps ST92 and ST93. If "YES" is obtained at the step ST92, the operation goes to the step ST94 where a message information "The print count has reached 3000. Please replace the process cartridge by a new one by referring to the printed manual." is read out. The message is converted into image data at the step ST95 and printed out at the step ST96.

According to the present invention, as has been described above, there is provided an image forming apparatus capable of allowing an operator to easily perform replacement and cleaning without needing the maintenance manual at the time of replacement of expendables and cleaning of a corona wire or the like.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus comprising:

first means for storing image information of an original to be formed on one sheet;

second means for storing message information contained in maintenance manuals for the image forming apparatus to be formed on another sheet;

means for forming an image corresponding to one of said image information and message information on an image bearing member; and control means for controlling said image information means such that said image information formed on the image bearing member is transferred to the one sheet and said message information formed on the image bearing member is transferred to another sheet, respectively.

2. An image forming apparatus according to claim 1, wherein said image forming means includes a photosensitive drum;

charging means for charging said photosensitive drum;

exposing means for exposing said photosensitive drum charged by said charging means in accordance with the message information, developing means for developing an electrostatic latent image formed on said photosensitive drum upon exposure by said exposing means, transfer means for transferring a developing agent image developed by said developing means to a transfer medium, fixing means for fixing the transfer medium on which the developing agent image is transferred by said transfer means, and image processing means for sequentially causing said exposure means to expose said photosensitive drum charged by said charging means, in accordance with the message information converted by said converting means, causing said developing means to develop the latent image, causing said transfer means to transfer the developing agent image, and causing said fixing means to fix the developing agent image on the transfer medium, thereby forming an image.

3. An apparatus according to claim 1, wherein said detecting means includes means for calculating a difference between a previous message information print count and a present image formation print count, and means for comparing the difference with a predetermined value.

4. An apparatus according to claim 1, wherein said image forming means further comprises display means for displaying said image information.

5. An apparatus according to claim 1, wherein said counting a means includes means for counting net image forming count and means for comparing the net image forming count and an integer multiple of a predetermined number and for outputting a message information reading signal when a coincidence is obtained in said comparing means.

6. An image forming apparatus according to claim 1, further comprising detecting means for detecting a total amount of use of the image forming means, and wherein said control means include means for reading out the message information from said second means, when the total amount of use of the image forming means is detected to reach a predetermined number.

7. An image forming apparatus comprising:

means for storing message information contained in maintenance manuals;

means for forming an image on an image bearing member;

first detecting means for detecting the amount of use of the forming means;

means for reading the message information from said storing means when the detecting means detects the predetermined amount of use;

means for converting the message information read out by said reading means into image information;

means for outputting an image of the image information as a visible image in accordance with the image information converted by said converting means;

means for receiving image data of a predetermined amount;

second detecting means for detecting that the image data is completely output to said image outputting means and thereupon outputting a detection output;

control means for controlling said image forming means such that while said detection output is not output from said second detecting means, an image corresponding to said image data is formed on the image bearing member and, when said detection output is output from said second detecting means, another image corresponding to the message information stored in said storing means is formed on the image bearing means; and means for transferring the image corresponding to said image data to a sheet and the other image corresponding to said message information to another sheet, respectively.

8. An apparatus according to claim 7, wherein said message information stored in said memory means includes a message for replacing said unit.

9. An image forming apparatus comprising:

an image bearing member;

means for acting on the image bearing member;

a unit having the image bearing member and the acting means, and removably located on a body of the apparatus;

means for storing message information contained in a maintenance manual to replace the unit;

means for detecting the amount of use of the unit;

means for reading the message information from the storing means when the detecting means detects a predetermined amount of use;

control means for controlling said acting means such that while said detecting means does not detect the predetermined amount of use, an image corresponding to image data is formed on the image bearing member and, when said detecting means detects the predetermined amount of use, another image corresponding to the message information stored in said storing means is formed on the image bearing means; and means for transferring the image corresponding to said image data to a sheet and the other image corresponding to said message information to another sheet, respectively.

10. An image forming apparatus comprising:

means for storing message information contained in maintenance manuals;

means for forming an image on a photosensitive member;

means for detecting the amount of use of the forming means;

means for reading the message information from the storing means when the detecting means detects a predetermined amount of use, so as to form the message information on the photosensitive member by the forming means;

control means for controlling said image forming means such that while said detecting means does not detect the predetermined use, a first image other than said message information is formed on the photosensitive member and, when said detecting means detects the predetermined use, a second image corresponding to the message information stored in said storing means is formed on the photosensitive member; and means for transferring the first image formed on the photosensitive member to a sheet and the second image corresponding to said message information to another sheet, respectively.

* * * * *